US011705290B2

(12) United States Patent
Kultalahti

(10) Patent No.: US 11,705,290 B2
(45) Date of Patent: Jul. 18, 2023

(54) CONTROL MODULE, CONTROL MODULE ASSEMBLY, AND ELECTRIC SWITCH COMPRISING THE CONTROL MODULE ASSEMBLY

(71) Applicant: ABB Schweiz AG, Baden (CH)

(72) Inventor: Antti Kultalahti, Vaasa (FI)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 17/587,274

(22) Filed: Jan. 28, 2022

(65) Prior Publication Data

US 2022/0270833 A1 Aug. 25, 2022

(30) Foreign Application Priority Data

Feb. 24, 2021 (EP) ..... 21159051

(51) Int. Cl.
*H01H 3/40* (2006.01)
*H01H 9/02* (2006.01)

(52) U.S. Cl.
CPC ..... *H01H 3/40* (2013.01); *H01H 9/02* (2013.01)

(58) Field of Classification Search
CPC .. H01H 9/02; H01H 3/40; H01H 3/10; H01H 9/26; H01H 33/02; H01H 19/03
USPC ..... 200/501, 570
See application file for complete search history.

(56) References Cited

U.S. PATENT DOCUMENTS 7,863,530 B2 * 1/2011 Mattlar ..... H01H 19/64 200/50.32
2019/0326082 A1 * 10/2019 Strand ..... H01H 3/40

FOREIGN PATENT DOCUMENTS

| | | | |
|---|---|---|---|
| DE | 102017106039 | A1 | 9/2017 |
| EP | 0823720 | A1 | 2/1998 |
| EP | 1648008 | A1 | 4/2006 |
| EP | 3561839 | A1 | 10/2019 |
| GB | 2571365 | A | 8/2019 |
| WO | 2005069323 | A1 | 7/2005 |
| WO | 2016165054 | A1 | 10/2016 |
| WO | 2018024531 | A1 | 2/2018 |

OTHER PUBLICATIONS

Extended European Search Report; Application No. 21159051.8; Completed: Jul. 22, 2021; dated Aug. 2, 2021; 5 Pages.

* cited by examiner

*Primary Examiner* — Edwin A. Leon
*Assistant Examiner* — Iman Malakooti
(74) *Attorney, Agent, or Firm* — Whitmyer IP Group LLC

(57) ABSTRACT

A control module for an electric switch comprising: a body part, a main control shaft, an operating shaft and a drive system operationally connecting the main control shaft to the operating shaft such that the operating shaft is adapted to be rotated by the main control shaft. Rotation axes of the main control shaft and operating shaft are perpendicular to each other. The body part comprises a first side wall, a second side wall, a top wall and a bottom wall. The bottom wall is provided with a bottom recess adapted to receive a portion of an add-on, a bottom part of the main control shaft being accessible through the bottom recess.

16 Claims, 5 Drawing Sheets

CONTROL MODULE, CONTROL MODULE ASSEMBLY, AND ELECTRIC SWITCH COMPRISING THE CONTROL MODULE ASSEMBLY

TECHNICAL FIELD

The present invention relates to a control module for an electric switch, to a control module assembly for the electric switch comprising the control module, and to an electric switch comprising the control module assembly.

BACKGROUND

A known control module for an electric switch, and a modular electric switch comprising the control module is disclosed in document EP 3 561 839. The known control module comprises a body part, a main control shaft, an operating shaft, and a drive system operationally connecting the main control shaft to the operating shaft such that the operating shaft is adapted to be rotated by the main control shaft. The main control shaft is adapted to be operated both from the direction of a top wall of the body part and from the direction of a bottom wall of the body part.

In some electric switch assemblies, it is required to be able to operate the control module from a direction of the operating shaft. In the above-mentioned known control module the operating shaft is accessible from both ends thereof but due to electrical safety regulations, it is not allowed to connect an operating handle directly to the operating shaft. Said direct connection is not permitted since an intermediate position between a conducting state and a non-conducting state is not allowed in an electric switch. Therefore, the drive system between the main control shaft and the operating shaft must be an indirect drive system which only allows a conducting state and a non-conducting state but no intermediate positions for the electric switch. In said known control module, the indirect drive system comprises a separate actuator and two actuator springs connected between the body part and the actuator.

It is known in the art to provide the known control module with an add-on comprising an accessory control shaft extending parallel to the operating shaft of the control module, and transmission means for transferring torque from the accessory control shaft to a bottom part of the main control shaft such that rotation of the main control shaft by the accessory control shaft is enabled.

One of the problems associated with a control module assembly comprising the known control module and the known add-on is that a dimension of the control module assembly in a depth direction is greater than corresponding dimension of the control module without the add-on. Depending on dimensions of pole modules of an electric switch, the add-on may also increase a total dimension of the electric switch in the depth direction. The depth direction is parallel to a rotation axis of the main control shaft.

SUMMARY

An object of the present invention is to provide a control module, a control module assembly comprising the control module, and an electric switch comprising the control module assembly so as to solve the above problems. The objects of the invention are achieved by a control module, a control module assembly and an electric switch which are described in the following.

The invention is based on the idea of providing a bottom wall of a body part of a control module with a bottom recess adapted to receive a portion of an add-on.

An advantage of the control module assembly of the invention is that its dimension in the depth direction is smaller than a corresponding dimension of a known control module assembly.

In an embodiment, a dimension of the control module assembly in the depth direction is the same as a corresponding dimension of the control module without the add-on.

BRIEF DESCRIPTION OF THE DRAWINGS

In the following the invention will be described in greater detail by means of preferred embodiments with reference to the attached drawings, in which.

DETAILED DESCRIPTION

Figure 1:
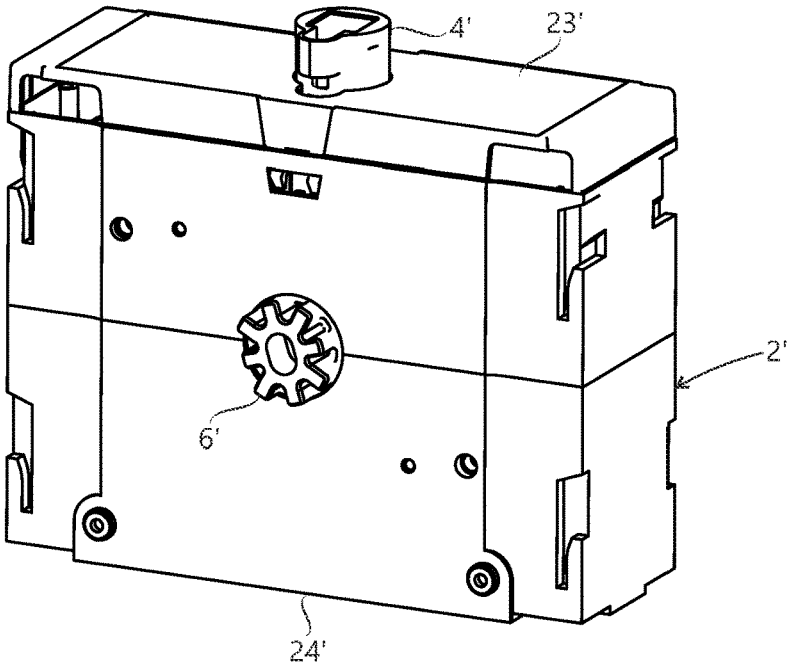
Fig. 1 (PRIOR ART)
FIG. 1 shows a known control module.
Figure 2:
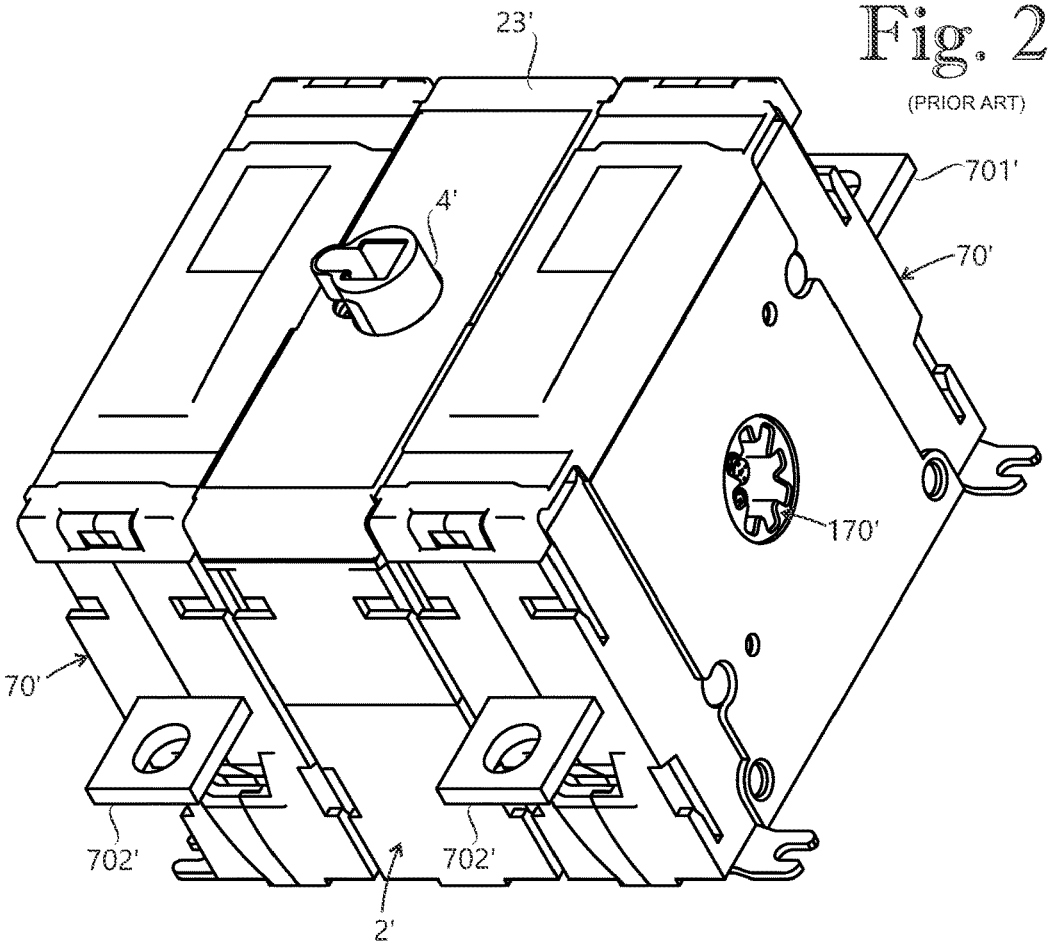
Fig. 2 (PRIOR ART)
FIG. 2 shows an electric switch comprising the control module of FIG. 1 and two pole modules.
Figure 3:
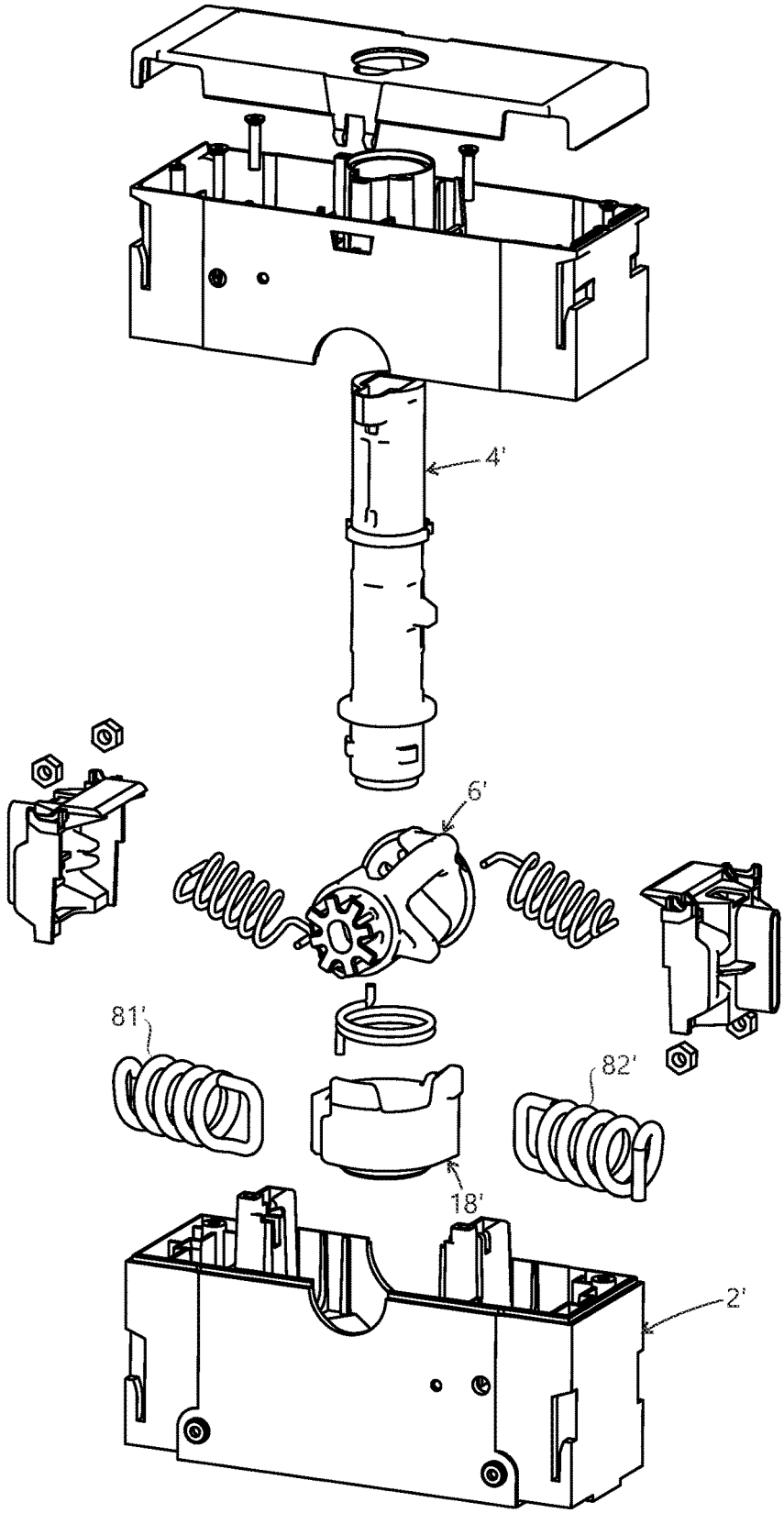
Fig. 3 (PRIOR ART)
FIG. 3 shows an exploded view of the control module of FIG. 1.

FIG. 1 shows a known control module. FIG. 2 shows an electric switch comprising the control module of FIG. 1 and two known pole modules. FIG. 3 shows an exploded view of the control module of FIG. 1. A structure of the control module of FIGS. 1 to 3 is discloses in document EP 3 561 839. Reference numbers used in FIGS. 1 to 3 differ from ones used in said prior art document.

The known control module shown in FIGS. 1 to 3 has a body part 2', a main control shaft 4' accessible from directions of a top wall 23' and bottom wall 24', and an operating shaft 6'. The top wall 23' and the bottom wall 24' are planar walls. FIG. 2 shows that dimensions of the body parts of the pole modules in longitudinal and depth directions are identical to corresponding dimensions of the body part of the control module.

Figure 4A:
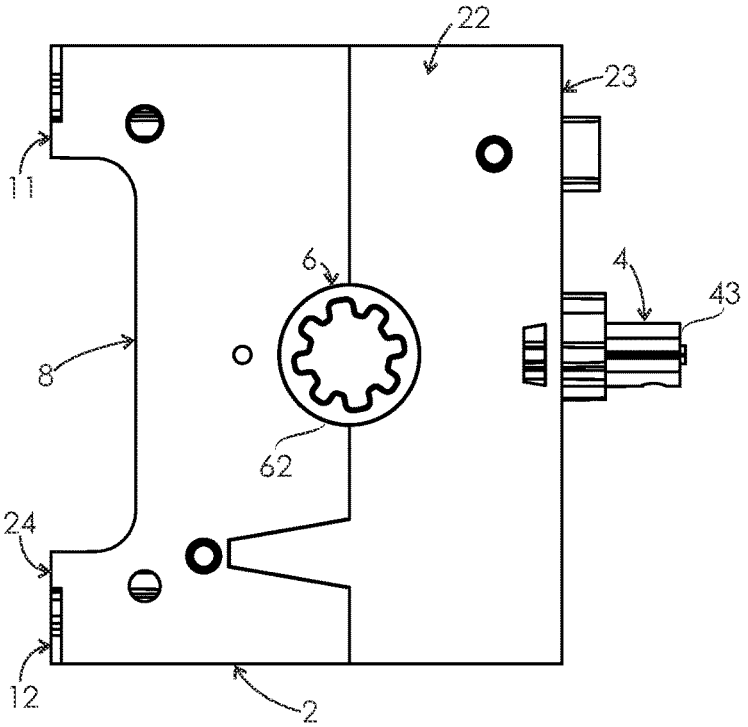
FIGS. 4*a* to 4*d* show a control module according to an embodiment of the invention from different directions.
Figure 4B:
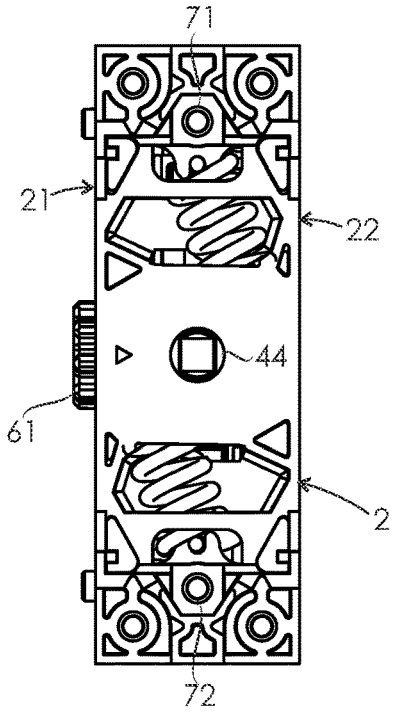
Figure 4C:
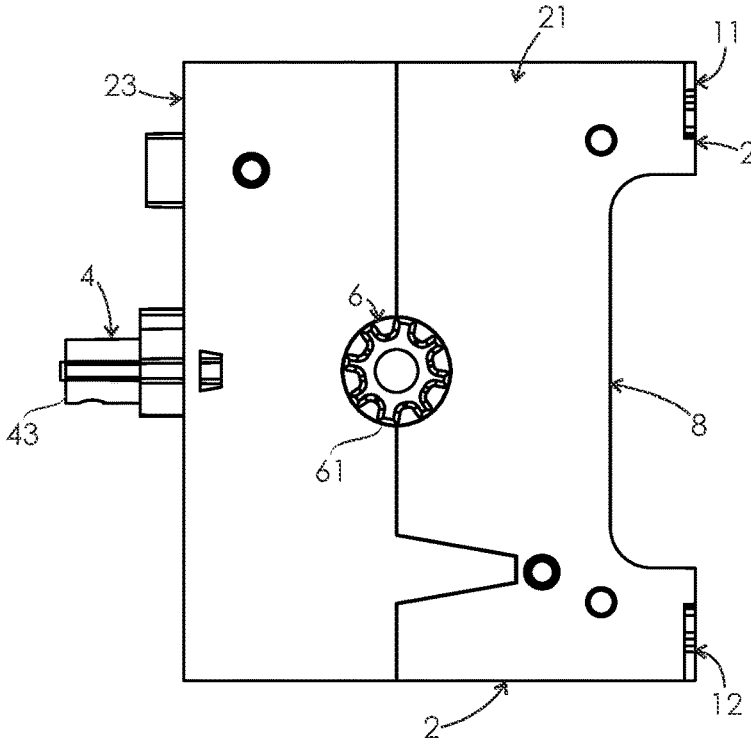
Figure 4D:
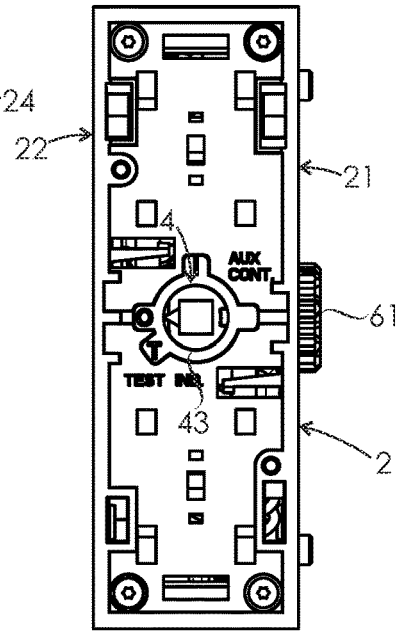

FIGS. 4*a* to 4*d* show a control module according to an embodiment of the invention from different directions. FIG. 4*a* shows the control module from one side. FIG. 4*b* shows the control module from below. FIG. 4*c* shows the control module from another side. FIG. 4*d* shows the control module from above.

The control module shown in FIGS. 4*a* to 4*d* comprises a body part 2, a main control shaft 4, an operating shaft 6, and a drive system operationally connecting the main control shaft 4 to the operating shaft 6 such that the operating shaft 6 is adapted to be rotated by the main control shaft 4.

The body part 2 has a depth direction, a width direction and a longitudinal direction, which are perpendicular relative to each other. In FIG. 4*a*, the depth direction is a horizontal direction, the width direction is perpendicular to the image plane, and the longitudinal direction is a vertical direction. The body part 2 comprises a first side wall 21 and second side wall 22 located at a distance from each other in the width direction, and a top wall 23 and a bottom wall 24 located at a distance from each other in the depth direction. The first side wall 21, the second side wall 22 and the top wall 23 are planar walls.

The main control shaft 4 is mounted to the body part 2, extends in the depth direction, and is rotatable around a first rotation axis. The first rotation axis is parallel to the depth direction. The main control shaft 4 has a top part 43 accessible from the direction of the top wall 23, and a bottom part 44 accessible from a direction of the bottom wall 24. The main control shaft 4 is adapted to be connected to an operating handle (not shown) which is adapted to be operated by the user.

The operating shaft 6 is mounted to the body part 2, extends in the width direction, and is rotatable around a second rotation axis perpendicular to the first rotation axis. The second rotation axis is parallel to the width direction. The operating shaft 6 has a first end 61 accessible from a direction of the first side wall 21 for transferring torque to at least one pole of the electric switch for changing state of the at least one pole. The first end 61 of the operating shaft 6 is provided with a male connecting member of a grooved shaft type. The operating shaft 6 further has a second end 62 accessible from a direction of the second side wall 22. The second end 62 of the operating shaft 6 is provided with a female connecting member which is adapted to be connected to a male connecting member similar to the one provided on the first end 61 of the operating shaft 6.

An internal structure of the control module is not shown in FIGS. 4*a* to 4*d*. The internal structure corresponds to the known structure shown in FIG. 3. In the structure shown in FIG. 3, the main control shaft 4' passes through the operating shaft 6', and the drive system is an indirect drive system which comprises a separate actuator 18' and two actuator springs 81' and 82' connected between the body part 2' and the actuator 18'. It should be noted that while the operating principle of the known control module can be used in a control module according to present invention, it might be necessary to change some dimensions of the components, such as depth dimension of the actuator. In an alternative embodiment, the drive system is an indirect drive system comprising some other known structure suitable for a control module.

FIGS. 4*a* and 4*c* show that the bottom wall 24 of the body part 2 is provided with a bottom recess 8 adapted to receive a portion of an add-on. The bottom part 44 of the main control shaft 4 is accessible through the bottom recess 8.

The bottom recess 8 extends through the body part 2 in the width direction. A dimension of the bottom recess 8 in the depth direction is approximately 17% of the dimension of the body part. A dimension of the bottom recess 8 in the longitudinal direction is approximately 63% of the dimension of the body part. In alternative embodiments, a dimension of the bottom recess in the depth direction is greater than or equal to 5% of the dimension of the body part, and a dimension of the bottom recess in the longitudinal direction is greater than or equal to 20% of the dimension of the body part.

The bottom recess 8 is provided with two screw holes 71 and 72 adapted for fixing the add-on to the bottom recess 8 by means of two screws. Each of the screw holes 71 and 72 extends parallel to the depth direction.

The bottom wall 24 of the body part 2 comprises a first support portion 11 and a second support portion 12 spaced apart in the longitudinal direction such that the bottom recess 8 is located between the first support portion 11 and the second support portion 12. The first support portion 11 and the second support portion 12 extend further from the top wall 23 in the depth direction than the bottom recess 8. The first support portion 11 and the second support portion 12 define a support plane that is parallel to a plane defined by the top wall 23.

Figure 5A:
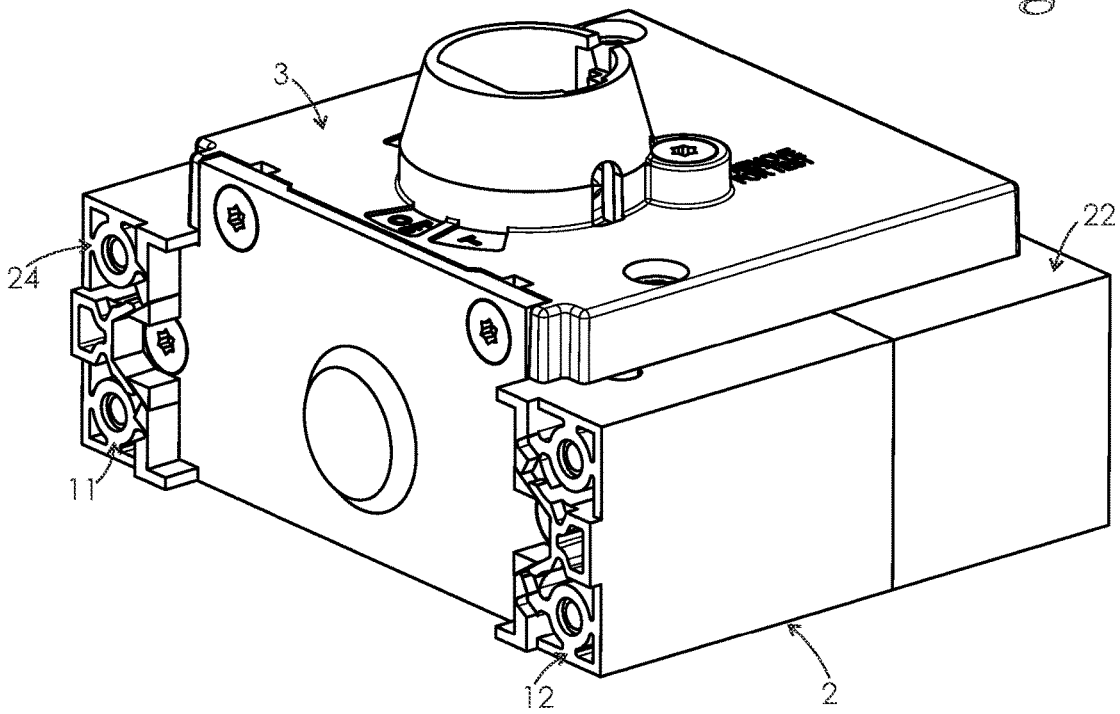
FIGS. 5*a* to 5*c* show a control module assembly comprising the control module of FIG. 4*a* and an add-on from different directions.
Figure 5B:
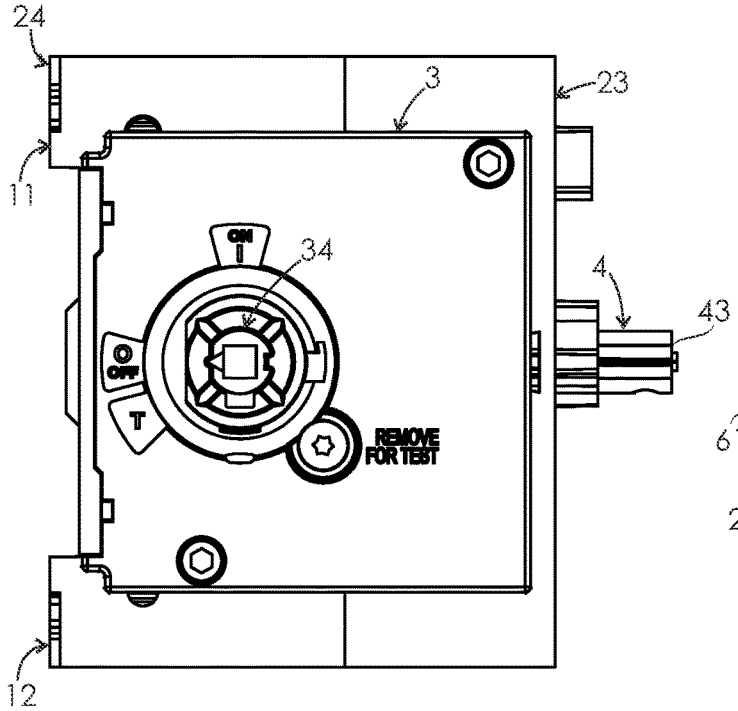
Figure 5C:
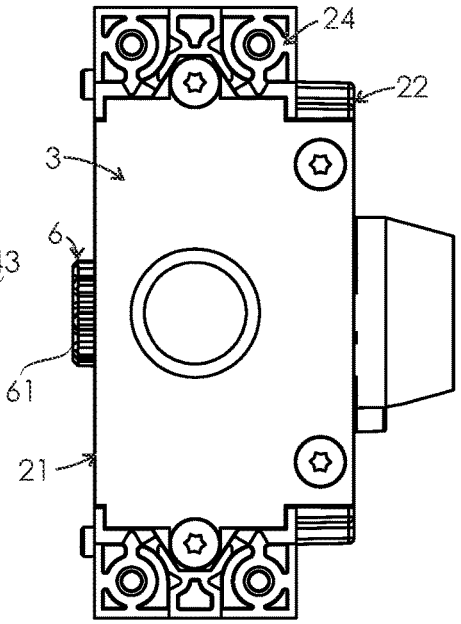
Figure 6:
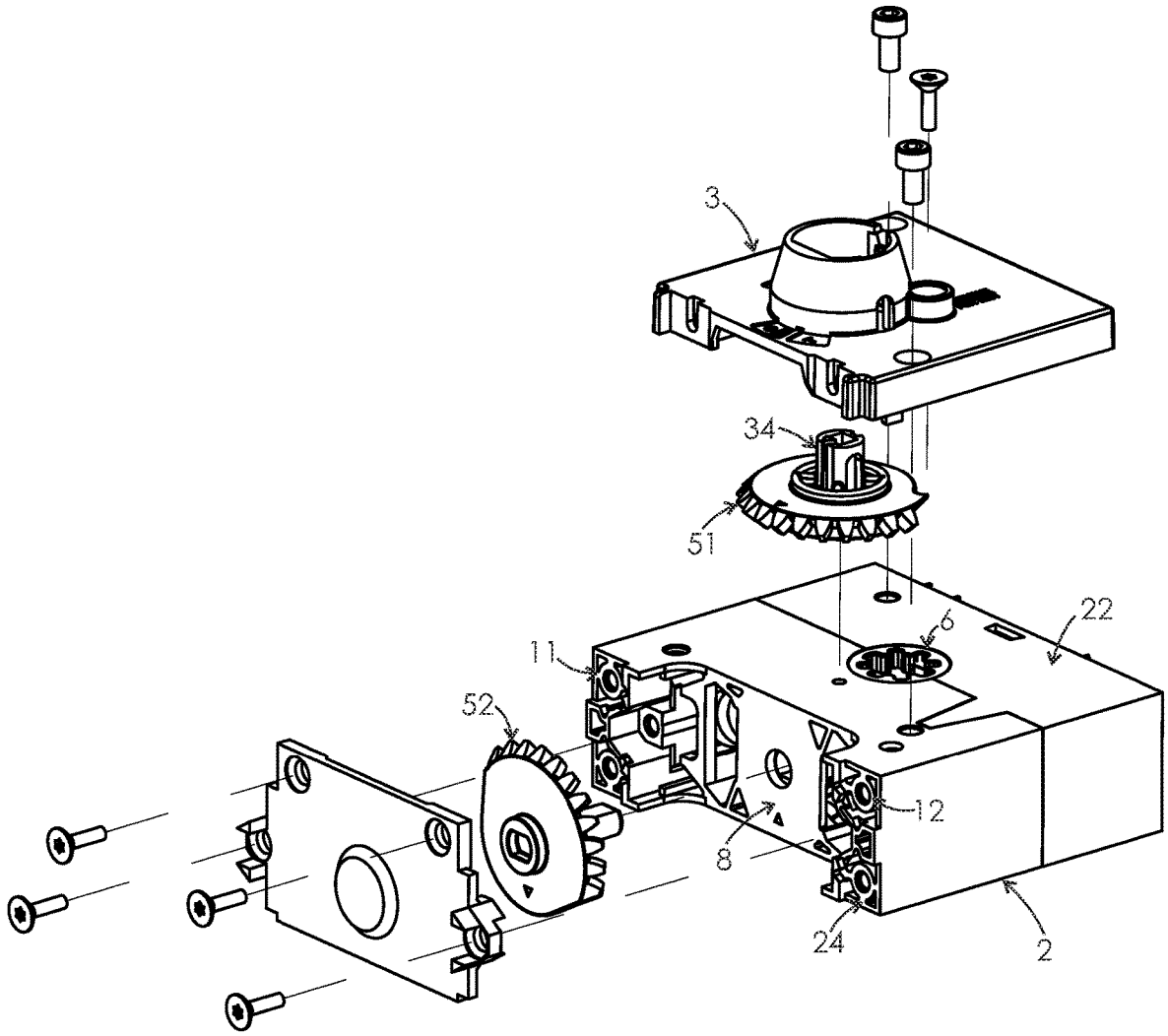
FIG. 6 shows an exploded view of the control module assembly of FIG. 5*a*.

FIGS. 5*a* to 5*c* show a control module assembly comprising the control module shown in FIGS. 4*a* to 4*d* and an add-on 3 from different directions. FIG. 6 shows an exploded view of the control module assembly of FIGS. 5*a* to 5*c*.

In the control module assembly of FIGS. 5*a* to 5*c*, the add-on 3 is partially received in the bottom recess 8. The add-on 3 comprises an accessory control shaft 34 and transmission means.

The accessory control shaft 34 extends in the width direction, and is rotatable around a third rotation axis. The accessory control shaft 34 is accessible from the direction of the second side wall 22. The third rotation axis is parallel to the second rotation axis. The first, second and third rotation axes are mathematical lines.

The transmission means is adapted for transferring torque from the accessory control shaft 34 to the bottom part 44 of the main control shaft 4 such that rotation of the main control shaft 4 by the accessory control shaft 34 is enabled. The transmission means comprises a first gear 51 and a second gear 52. The first gear 51 has a plurality of first teeth, and is stationary connected to the accessory control shaft 34. A rotation axis of the first gear 51 coincides with the third rotation axis. The second gear 52 has a plurality of second teeth, and is connected to the main control shaft 4. A rotation axis of the second gear 52 coincides with the first rotation axis. The plurality of second teeth are operationally connected to the plurality of first teeth for transferring torque from the first gear 51 to the second gear 52. A transmission ratio between the first gear 51 and the second gear 52 is 1:1.

The second gear 52 is an asymmetrical gear in order to reduce dimension of the add-on 3 in the width direction. The second gear 52 has second teeth only on a tooth sector thereof. A central angle of the tooth sector is less than 180°. The asymmetrical form of the second gear 52 is possible since an angle between extreme positions of the accessory control shaft 34 is approximately 135°.

FIG. 5*b* shows the control module assembly from a direction parallel to the second rotation axis. FIG. 5*b* shows that the add-on 3 is dimensioned such that it does not extend further in the depth direction than the body part 2 of the control module.

FIG. 5*c* shows the control module assembly from below such that the image plane is perpendicular to the first rotation axis. FIG. 5*c* shows that the add-on 3 is dimensioned such that it does not extend further in the width direction than the first side wall 21 of the body part 2.

An electric switch according to an embodiment comprises a control module assembly of FIG. 5*a*, and at least one pole module 70' connected to the control module assembly. Unlike in FIG. 2, the at least one pole module 70' is connected on the side of the first side wall 21 since the side of the second side wall 22 is occupied by the add-on 3.

Each of the at least one pole module comprises a pole module body, a pole shaft 170', a first stationary terminal 701', a second stationary terminal 702' and a movable contact. The pole shaft 170' is mounted to the pole module body, extends in the width direction, and is operationally connected to the first end 61 of the operating shaft 6 for rotation around the second rotation axis with the operating shaft 6. A rotation axis of the pole shaft 170' coincides with the second rotation axis.

The first stationary terminal 701' is stationary fixed to the pole module body. The second stationary terminal 702' is stationary fixed to the pole module body. The movable contact is stationary mounted to the pole shaft 170', and is rotatable relative to the pole module body between a first position in which the movable contact electrically conductively connects the first stationary terminal 701' to the second stationary terminal 702', and a second position in which the first stationary terminal 701' and the second stationary terminal 702' are disconnected from each other.

It will be obvious to a person skilled in the art that the inventive concept can be implemented in various ways. The invention and its embodiments are not limited to the examples described above but may vary within the scope of the claims.

The invention claimed is:

1. A control module assembly for an electric switch comprising:

a control module, which includes:

a body part having a depth direction, a width direction and a longitudinal direction, which are perpendicular relative to each other, the body part comprising a first side wall and second side wall located at a distance from each other in the width direction, and a top wall and a bottom wall located at a distance from each other in the depth direction;

a main control shaft mounted to the body part, extending in the depth direction, and rotatable around a first rotation axis, the main control shaft having a bottom part accessible from a direction of the bottom wall;

an operating shaft mounted to the body part, extending in the width direction, rotatable around a second rotation axis perpendicular to the first rotation axis, and having a first end accessible from a direction of the first side wall for transferring torque to at least one pole of the electric switch for changing state of the at least one pole; and a drive system operationally connecting the main control shaft to the operating shaft such that the operating shaft is adapted to be rotated by the main control shaft;

wherein the bottom wall is provided with a bottom recess, the bottom part of the main control shaft being accessible through the bottom recess; and an add-on adapted to be partially received in the bottom recess, the add-on comprising:

an accessory control shaft extending in the width direction, and rotatable around a third rotation axis, the accessory control shaft being accessible from the direction of the second side wall when the add-on is partially received in the bottom recess; and transmission means for transferring torque from the accessory control shaft to the bottom part of the main control shaft such that rotation of the main control shaft by the accessory control shaft is enabled.

2. The control module assembly according to claim 1, wherein the main control shaft has a top part accessible from the direction of the top wall.

3. The control module assembly according to claim 1, wherein the bottom recess extends through the body part in the width direction.

4. The control module assembly according to claim 1, wherein the bottom wall of the body part comprises a first support portion and a second support portion spaced apart in the longitudinal direction such that the bottom recess is located between the first support portion and the second support portion.

5. The control module assembly according to claim 1, wherein the bottom recess is provided with at least one screw hole adapted for fixing the add-on to the bottom recess by means of at least one screw.

6. The control module assembly according to claim 2, wherein the bottom recess extends through the body part in the width direction.

7. The control module assembly according to claim 2, wherein the bottom wall of the body part comprises a first support portion and a second support portion spaced apart in the longitudinal direction such that the bottom recess is located between the first support portion and the second support portion.

8. The control module assembly according to claim 2, wherein the bottom recess is provided with at least one screw hole adapted for fixing the add-on to the bottom recess by means of at least one screw.

9. A control module assembly for an electric switch comprising:

a control module, which includes:

a body part having a depth direction, a width direction and a longitudinal direction, which are perpendicular relative to each other, the body art comprising a first side wall and second side wall located at a distance from each other in the width direction and a top wall and a bottom wall located at a distance from each other in the depth direction;

a main control shaft mounted to the body part, extending in the depth direction, and rotatable around a first rotation axis, the main control shaft having a bottom part accessible from a direction of the bottom wall;

an operating shaft mounted to the body part, extending in the width direction, rotatable around a second rotation axis perpendicular to the first rotation axis, and having a first end accessible from a direction of the first side wall for transferring torque to at least one ole of the electric switch for changing state of the at least one pole; and a drive system operationally connecting the main control shaft to the operating shaft such that the operating shaft is adapted to be rotated by the main control shaft;

wherein the bottom wall is provided with a bottom recess, the bottom part of the main control shaft being accessible through the bottom recess; and an add-on partially received in the bottom recess, the add-on comprising:

an accessory control shaft extending in the width direction, and rotatable around a third rotation axis, the accessory control shaft being accessible from the direction of the second side wall; and transmission means for transferring torque from the accessory control shaft to the bottom part of the main control shaft such that rotation of the main control shaft by the accessory control shaft is enabled.

10. The control module assembly according to claim 9, wherein the transmission means comprises:

a first gear having a plurality of first teeth, and connected to the accessory control shaft, a rotation axis of the first gear coinciding with the third rotation axis; and a second gear having a plurality of second teeth, and connected to the main control shaft, a rotation axis of the second gear coinciding with the first rotation axis, the plurality of second teeth being operationally connected to the plurality of first teeth for transferring torque from the first gear to the second gear.

11. The control module assembly according to claim 10, wherein the second gear is an asymmetrical gear in order to reduce dimension of the add-on in the width direction.

12. The control module assembly according to claim 10, wherein the add-on is dimensioned such that it does not extend further in the depth direction than the body part of the control module, and does not extend further in the width direction than the first side wall of the body part.

13. The control module assembly according to claim 9, wherein the add-on is dimensioned such that it does not extend further in the depth direction than the body part of the control module, and does not extend further in the width direction than the first side wall of the body part.

14. An electric switch comprising:

a control module assembly having:

a control module, which includes:

a body part having a depth direction, a width direction and a longitudinal direction, which are perpendicular relative to each other, the body part comprising a first side wall and second side wall located at a distance from each other in the width direction, and a top wall and a bottom wall located at a distance from each other in the depth direction;

a main control shaft mounted to the body part, extending in the depth direction, and rotatable around a first rotation axis, the main control shaft having a bottom part accessible from a direction of the bottom wall;

an operating shaft mounted to the body part, extending in the width direction, rotatable around a second rotation axis perpendicular to the first rotation axis, and having a first end accessible from a direction of the first side wall for transferring torque to at least one pole of the electric switch for changing state of the at least one pole; and a drive system operationally connecting the main control shaft to the operating shaft such that the operating shaft is adapted to be rotated by the main control shaft;

wherein the bottom wall is provided with a bottom recess, the bottom part of the main control shaft being accessible through the bottom recess; and an add-on that is partially received in the bottom recess, the add-on includes:

an accessory control shaft extending in the width direction, and rotatable around a third rotation axis, the accessory control shaft being accessible from the direction of the second side wall; and transmission means for transferring torque from the accessory control shaft to the bottom part of the main control shaft such that rotation of the main control shaft by the accessory control shaft is enabled; and at least one pole module connected to the control module assembly, each of the at least one pole module having:

a pole module body;

a pole shaft mounted to the pole module body, extending in the width direction, and operationally connected to the first end of the operating shaft for rotation around the second rotation axis with the operating shaft;

a first stationary terminal stationary fixed to the pole module body;

a second stationary terminal stationary fixed to the pole module body; and a movable contact stationary mounted to the pole shaft, and rotatable relative to the pole module body between a first position in which the movable contact electrically conductively connects the first stationary terminal to the second stationary terminal, and a second position in which the first stationary terminal and the second stationary terminal are disconnected from each other.

15. The electric switch according to claim 14, wherein the transmission means comprises:

a first gear having a plurality of first teeth, and connected to the accessory control shaft, a rotation axis of the first gear coinciding with the third rotation axis; and a second gear having a plurality of second teeth, and connected to the main control shaft, a rotation axis of the second gear coinciding with the first rotation axis, the plurality of second teeth being operationally connected to the plurality of first teeth for transferring torque from the first gear to the second gear.

16. The electric switch according to claim 14, wherein the second gear is an asymmetrical gear in order to reduce dimension of the add-on in the width direction.

* * * * *